US011773690B2

(12) United States Patent
Patel et al.

(10) Patent No.: US 11,773,690 B2
(45) Date of Patent: Oct. 3, 2023

(54) COMBINED VALVE SYSTEM AND METHODOLOGY

(71) Applicant: SCHLUMBERGER TECHNOLGY CORPORATION, Sugar Land, TX (US)

(72) Inventors: Dinesh R. Patel, Sugar Land, TX (US); Sudhakar Khade, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 486 days.

(21) Appl. No.: 16/191,959

(22) Filed: Nov. 15, 2018

(65) Prior Publication Data

US 2019/0145220 A1 May 16, 2019

Related U.S. Application Data

(60) Provisional application No. 62/671,593, filed on May 15, 2018, provisional application No. 62/586,434, filed on Nov. 15, 2017.

(51) Int. Cl.
*E21B 34/10* (2006.01)
*E21B 34/14* (2006.01)

(52) U.S. Cl.
CPC ..... *E21B 34/10* (2013.01); *E21B 34/14* (2013.01); *E21B 2200/04* (2020.05); *E21B 2200/06* (2020.05)

(58) Field of Classification Search
CPC .. E21B 34/10; E21B 2200/06; E21B 2200/04; E21B 34/14
See application file for complete search history.

(56) References Cited

U.S. PATENT DOCUMENTS 3,964,544 A * 6/1976 Farley ..... E21B 34/10 166/321
4,350,205 A * 9/1982 Goldschild ..... F16K 3/265 166/131
4,442,902 A * 4/1984 Doremus ..... E21B 33/0355 166/374
4,804,044 A * 2/1989 Wesson ..... E21B 49/001 175/4.52

(Continued)

OTHER PUBLICATIONS

SFIV-II—Surface-Controlled Bidirectional Isolation Valve, 2014 (2 pages).

*Primary Examiner* — Robert E Fuller
*Assistant Examiner* — Neel Girish Patel
(74) *Attorney, Agent, or Firm* — Jeffrey D. Frantz

(57) ABSTRACT

A technique facilitates operation of a valve system a having combined valve such as a combined formation isolation valve and a circulating valve. In well operations, the valve system is deployed downhole into a wellbore on a tubing string. The formation isolation valve and the circulating valve are operable independently via inputs, e.g. hydraulic inputs provided through less than three hydraulic control lines. The formation isolation valve and the circulating valve may be coupled by a mechanical linkage, which enables operation of the two valves via the hydraulic control lines. In some embodiments, the formation isolation valve and the circulating valve may be operated via an integrated shifting tool.

9 Claims, 13 Drawing Sheets

(56) References Cited

U.S. PATENT DOCUMENTS 5,341,883 A * 8/1994 Ringgenberg ..... E21B 34/103 166/324
5,411,097 A * 5/1995 Manke ..... E21B 34/10 166/324
5,819,853 A * 10/1998 Patel ..... E21B 34/063 166/373
6,085,845 A * 7/2000 Patel ..... E21B 33/068 166/332.3
6,220,359 B1 * 4/2001 Poulard ..... E21B 34/063 166/383
6,302,216 B1 * 10/2001 Patel ..... E21B 34/06 166/321
6,352,119 B1 * 3/2002 Patel ..... E21B 23/06 166/334.4
6,354,378 B1 3/2002 Patel
6,382,315 B1 * 5/2002 Langseth ..... E21B 49/081 166/265
6,782,952 B2 8/2004 Garay et al.
7,637,324 B2 12/2009 Anderson et al.
8,074,721 B2 12/2011 Guven et al.
8,256,518 B2 * 9/2012 Guven ..... E21B 23/006 166/373
8,973,663 B2 * 3/2015 Ringgenberg ..... E21B 21/10 166/324
9,388,661 B2 * 7/2016 Jasek ..... E21B 33/13
9,598,929 B2 3/2017 Patel
2001/0045285 A1 * 11/2001 Russell ..... E21B 21/106 166/332.3
2002/0029890 A1 * 3/2002 Patel ..... E21B 34/102 166/321
2002/0112862 A1 * 8/2002 Patel ..... E21B 34/102 166/321
2006/0021757 A1 * 2/2006 Patel ..... E21B 43/14 166/386
2008/0314590 A1 * 12/2008 Patel ..... E21B 34/06 166/227
2009/0071658 A1 * 3/2009 Reid ..... E21B 43/12 166/330
2009/0084553 A1 * 4/2009 Rytlewski ..... E21B 34/06 166/305.1
2009/0205833 A1 * 8/2009 Bunnell ..... E21B 34/16 166/57
2010/0206579 A1 * 8/2010 Guven ..... E21B 23/006 166/373
2011/0284232 A1 * 11/2011 Huang ..... E21B 34/14 977/775
2011/0297393 A1 * 12/2011 Patel ..... E21B 34/08 166/325
2012/0048564 A1 * 3/2012 Ringgenberg ..... E21B 34/102 166/332.1
2012/0073829 A1 * 3/2012 Smith ..... E21B 34/10 166/375
2013/0068472 A1 * 3/2013 Lauderdale ..... E21B 34/142 166/334.1
2013/0075109 A1 * 3/2013 Frisby ..... E21B 43/128 166/373
2013/0161027 A1 * 6/2013 Inglis ..... B23B 31/20 166/381
2013/0192848 A1 * 8/2013 Patel ..... E21B 34/06 166/373
2013/0213644 A1 * 8/2013 Buyers ..... E21B 41/00 166/250.15
2013/0340832 A1 * 12/2013 Lauderdale ..... E21B 34/10 137/559
2014/0158433 A1 * 6/2014 Bisset ..... E21B 34/08 175/218
2016/0362960 A1 12/2016 Ross et al.
2016/0376871 A1 * 12/2016 Voon ..... E21B 21/103 166/319
2018/0202269 A1 * 7/2018 Wensrich ..... E21B 43/128
2019/0145220 A1 * 5/2019 Patel ..... E21B 34/10 166/375
2020/0240265 A1 * 7/2020 Machocki ..... E21B 49/081
2022/0065080 A1 * 3/2022 Alkhalidi ..... E21B 47/12

* cited by examiner

COMBINED VALVE SYSTEM AND METHODOLOGY

CROSS-REFERENCE TO RELATED APPLICATION

The present document is based on and claims priority to U.S. Provisional Application Ser. No. 62/586,434, filed Nov. 15, 2017, and U.S. Provisional Application Ser. No. 62/671,593, filed May 15, 2018, which are incorporated herein by reference in their entirety.

BACKGROUND

In various well applications, a wellbore is drilled into a hydrocarbon bearing reservoir and then a pumping system may be deployed downhole. The pumping system is operated to pump oil and/or other fluids to the surface for collection. The pumping system may comprise an electric submersible pumping (ESP) system having a submersible pump powered by a submersible electric motor. In some applications, the electric submersible pumping system or other components are removed from the wellbore for servicing or other actions. While the components are removed, a valve system may be used to prevent flow of formation fluid up through the wellbore.

During a rigless ESP workover, for example, produced hydrocarbon fluid located in the well tubing may be bull headed into the surrounding formation with a heavy weight brine fluid. The formation/reservoir may then be isolated by closing a formation isolation valve and pulling the ESP system out of the wellbore for servicing. To avoid potential formation damage in certain operations, a separate surface controlled hydraulic sliding sleeve valve is used so as to circulate out the produced hydrocarbon fluid in the well tubing with brine fluid rather than bull heading the hydrocarbon fluid into the formation. However, at least four hydraulic control lines are used to operate both of the valves and running this number of control lines can be problematic in many types of well operations.

SUMMARY

In general, a system and methodology utilize a valve system having combined valves such as a combined formation isolation valve and a circulating valve. In well operations, the valve system may be deployed downhole into a wellbore on a tubing string. The formation isolation valve and the circulating valve are operable independently via hydraulic inputs which are provided through less than three hydraulic control lines, e.g. two hydraulic control lines. In some embodiments, a single hydraulic control line with a downhole switch may be used instead of the two separate hydraulic control lines routed to the surface. The formation isolation valve and the circulating valve may be coupled by a mechanical linkage, which enables operation of the two valves via the two hydraulic lines. Additionally, some embodiments may utilize a shifting tool attached to a lower end of an upper completion. The upper completion may comprise an electric submersible pumping system, and the shifting tool may be operably engaged with the formation isolation valve and the circulating valve.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which utilize a valve system having combined valves, e.g. a combined formation isolation valve and a circulating valve. By way of example, the formation isolation valve may be in the form of a lubricator valve, e.g. a ball valve actuated between open and closed positions via a ball valve actuator, and the circulating valve may be a sliding sleeve valve. In well operations, the valve system may be deployed downhole into a wellbore on a tubing string and the lubricator valve may be used to control flow along an internal, longitudinal flow passage. The circulating valve may be used to control flow through radial ports extending between the internal flow passage and an exterior of the valve system.

The formation isolation valve and the circulating valve are operable independently via hydraulic inputs, which are provided through less than three hydraulic control lines, e.g. two hydraulic control lines. The hydraulic control lines may be routed to a hydraulic control system, e.g. a surface control system to enable surface actuation of the formation isolation valve and circulating valve. The formation isolation valve and the circulating valve may be coupled by a mechanical linkage. The mechanical linkage enables operation of the two valves via two or fewer hydraulic control lines instead of the greater number of hydraulic lines used in conventional systems. In some embodiments, a single hydraulic control line with a downhole switch may be used instead of two separate hydraulic control lines routed to the surface.

In some embodiments, the system and methodology utilize a valve system having a combined formation isolation valve, e.g. a ball valve, and a circulating valve operated by a shifting tool. For example, the system may comprise an upper completion combined with a shifting tool attached to a lower end of the upper completion. In some embodiments, the upper completion may comprise an electric submersible pumping system. Additionally, the shifting tool may be operably engaged with the combined formation isolation valve and the circulating valve. The shifting tool is operable to selectively open and close the formation isolation valve and the circulating valve. Depending on the application, the shifting tool may comprise a hydraulic shifting tool, an electric shifting tool, or another type of suitably powered shifting tool.

Figure 1:
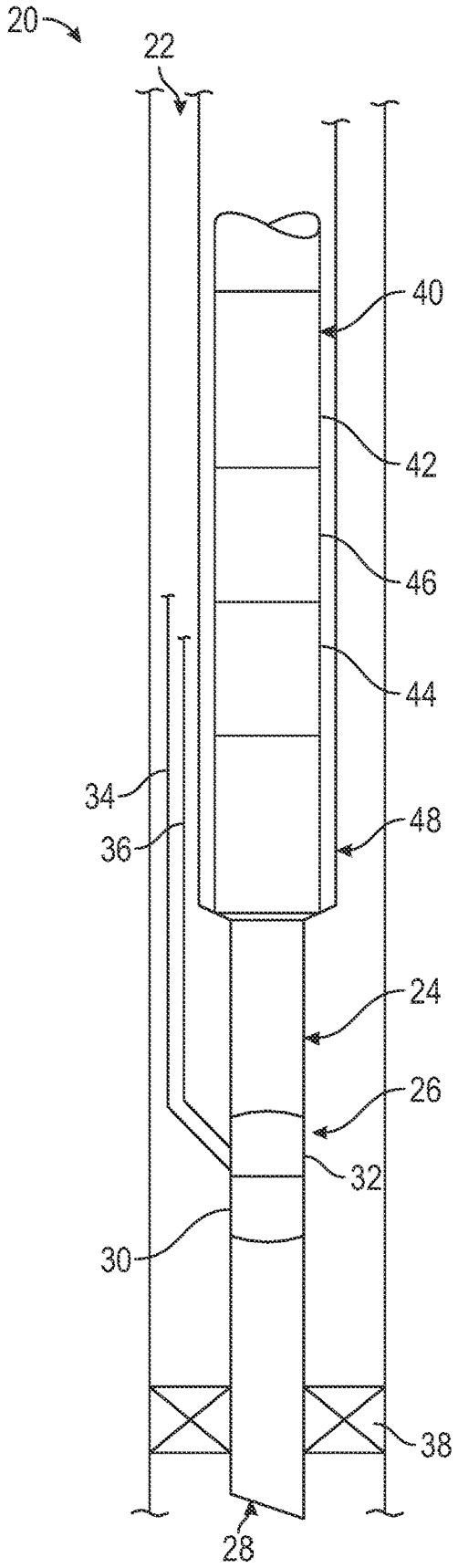
FIG. 1 is a schematic illustration of a well system deployed in a borehole and having a valve system, according to an embodiment of the disclosure.

Referring generally to FIG. 1, a well system 20 is illustrated as deployed in a borehole 22, e.g. a wellbore. In this example, the well system 20 comprises a tubing section 24, which may be deployed downhole in the wellbore 22. The tubing section 24 is coupled with a valve system 26 and has an internal flow passage 28 exposed to, for example, well fluids. The valve system 26 is a combined valve system having, for example, a formation isolation valve 30, e.g. a ball valve, and a circulating valve 32, e.g. a sliding sleeve valve. The valves 30, 32 are independently operable via hydraulic inputs provided through less than three hydraulic control lines. For example, the valves 30, 32 may be independently operable via a pair of hydraulic control lines 34, 36, e.g. a first hydraulic control line 34 and a second hydraulic control line 36. In some embodiments, the tubing section 24 may extend through a packer 38 or other wellbore isolation device.

Additionally, the tubing section 24 may be used with a variety of other types of well completions and well components. For example, the tubing section 24 may be used to deliver fluids, e.g. well fluids, to an electric submersible pumping system 40. By way of example, the electric submersible pumping system (ESPS) 40 may comprise a submersible pump 42 powered by a submersible motor 44 which is protected by a motor protector 46. The submersible motor 44 may be powered by electricity received via a power cable. In some applications, the tubing section 24 may be coupled with an ESP docking station 48 to form a completion into which the ESPS 40 is releasably deployed. However, the valve system 26 may be coupled into other types of well completions and other types of equipment to enable use of a plurality of valves with a reduced number of hydraulic control lines.

Figure 2:
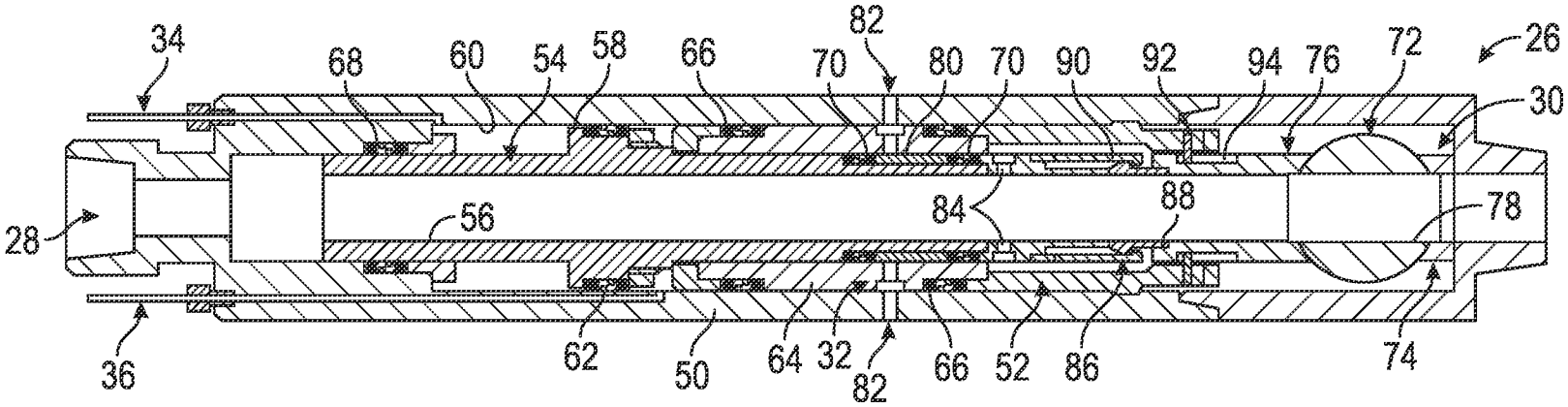
FIG. 2 is an illustration of a valve system having a combined formation isolation valve and circulating valve operable via less than three hydraulic lines, according to an embodiment of the disclosure.

Referring generally to FIG. 2, an example of valve system 26 is illustrated. In this embodiment, the combined valve system 26 comprises a valve housing 50 containing the formation isolation valve 30, e.g. lubricator valve, and the circulating valve 32, e.g. sliding sleeve valve. The formation isolation valve 30 and the circulating valve 32 are coupled by a mechanical linkage 52 which enables independent operation of the formation isolation valve 30 and the circulating valve 32 via the two flow control lines 34, 36.

In this example, the formation isolation valve 30 and the circulating valve 32 may be shifted between operational positions, e.g. between different flow positions, by an operator mandrel 54. The mandrel 54 comprises an internal mandrel flow passage 56 which is part of the overall internal flow passage 28. Additionally, the mandrel 54 comprises an expanded region 58 which serves as a piston to enable shifting of the mandrel 54 via application of hydraulic inputs through the pair of hydraulic control lines 34, 36. In some embodiments, the pair of hydraulic control lines 34, 36 may be replaced with a single hydraulic control line and a downhole switch for switching pressure from one side of the piston 58 to the other side of the piston 58. By way of example, the downhole switch may comprise an indexer. The indexer allows use of multiple pressure/bleed cycles to switch the pressure provided via a single hydraulic control line from one side of the piston 58 to the other side.

In the illustrated example, the radially expanded region 58 is disposed in a hydraulic chamber 60 and sealed against an interior surface of valve housing 50 via a seal 62. Hydraulic actuating fluid may be introduced into hydraulic chamber 60 on one side of piston 58 via first hydraulic control line 34 and into hydraulic chamber 60 on an opposite side of piston 58 via second hydraulic control line 36 to enable selective longitudinal movement of mandrel 54 in one direction or the other.

In some embodiments, the mandrel 54 may be slidably mounted within one or more sub housings 64, e.g. an annular sub housing, sealed with respect to housing 50 via suitable seals 66. In the example illustrated, a single sub housing 64 is used to help create hydraulic chamber 60 which is positioned longitudinally between the sub housing 64 and a portion of valve housing 50. It should be noted the mandrel 54 may be slidably sealed with respect to housing 50 and sub housing 64 via appropriately placed seals such as seals 62, 68, 70.

The formation isolation valve 30 and the circulating valve 32 may be constructed in various configurations. According to the illustrated embodiment, however, the formation isolation valve 30 may be in the form of a ball valve 72, which is rotatable against a ball seat 74 via a ball valve operator 76. The ball valve operator 76 is coupled with operator mandrel 54 via mechanical linkage 52. In this example, the ball valve 72 has a ball valve flow passage 78 which may be generally aligned with mandrel internal flow passage 56 to enable flow through the overall internal flow passage 28 (when ball valve 72 is actuated to the open flow position illustrated in FIG. 2).

In this example, the circulating valve 32 is in the form of a sliding sleeve valve having a sliding sleeve 80 which moves with mandrel 54 to selectively open flow or close off flow with respect to circulating ports 82. By way of example, circulating ports 82 may be radial ports which work in cooperation with corresponding ports 84 to enable flow between internal flow passage 28 and the exterior of valve system 26 when sliding sleeve 80 is in an open flow position. Corresponding ports 84 may be formed through mandrel 54 in, for example, a generally radial orientation. The open flow position is achieved when the sliding sleeve 80 is moved, via mandrel 54, away from circulating ports 82. As sliding sleeve 80 is moved, corresponding ports 84 are aligned with circulating ports 82. In FIG. 2, the circulating valve 32 is illustrated in the closed flow position and the formation isolation valve 30 is in the open flow position. This combination may be used as a running in hole (RIH) configuration.

As illustrated, the mechanical linkage 52 operatively couples functions of the formation isolation valve 30 and the circulating valve 32. In the embodiment illustrated, the mechanical linkage 52 is in the form of a collet 86 having a first collet member 88 with a detent. The first collet member 88 may be coupled with valve operator 76. The collet 86 also comprises a second collet member 90 coupled to the mandrel 54 and releasably engaged with first collet member 88. For example, at least one of the first and second collet members 88, 90 may be formed of a sufficiently flexible material to enable radial flexing and release upon application of sufficient axial loading on collet 86. It should be noted the movement of valve operator 76 also may be limited via a limit member 92, e.g. at least one limit pin, extending from valve housing 50 into a track or tracks 94 formed in valve operator 76.

Figure 3:
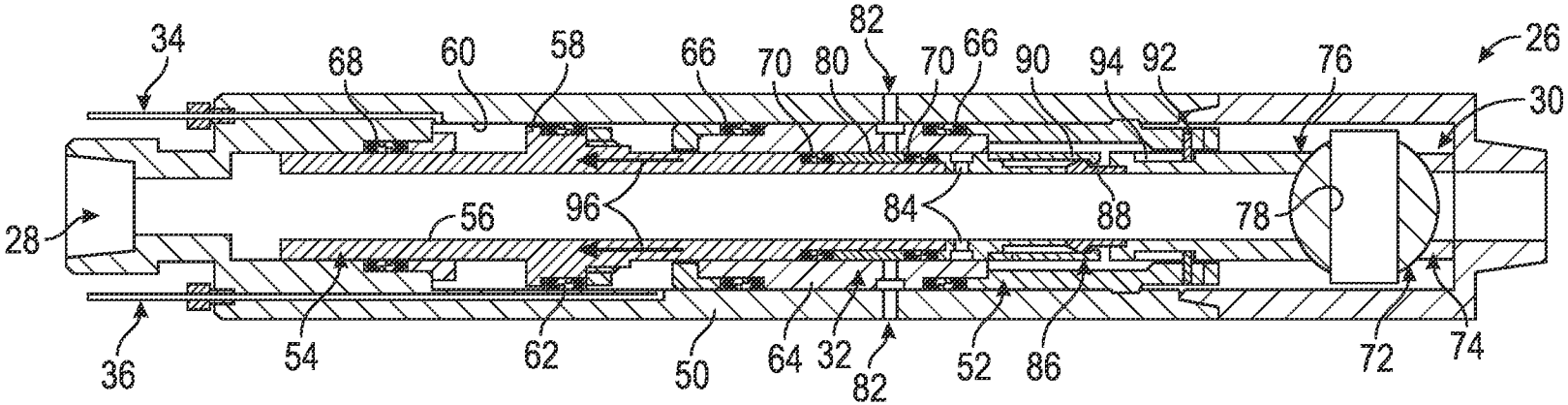
FIG. 3 is an illustration of the valve system of FIG. 2 in a different operational position, according to an embodiment of the disclosure.

With additional reference to FIG. 3, the formation isolation valve 30, e.g. ball valve 72, may be shifted to a closed position by supplying hydraulic actuating fluid via hydraulic control line 36 (and allowing fluid to bleed from hydraulic chamber 60 through hydraulic control line 34). The actuating fluid acts against piston 58 and shifts the operator mandrel 54 in the direction indicated by arrows 96. This shifting of operator mandrel 54 causes the engaged collet 86 to move valve operator 76, which rotates ball valve 72 to the closed position as illustrated.

Figure 4:
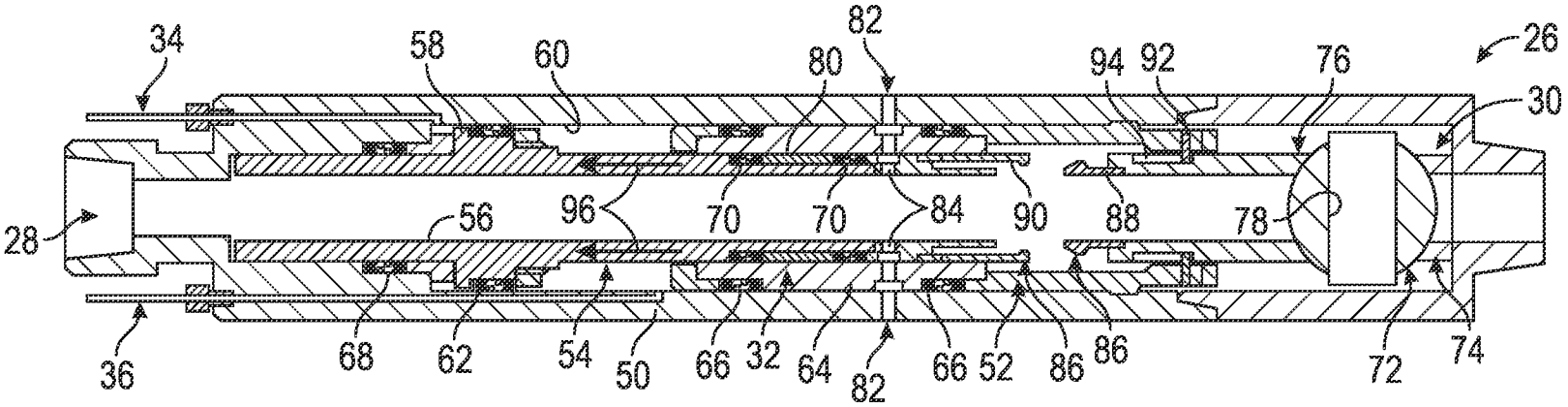
FIG. 4 is an illustration of the valve system of FIG. 2 in a different operational position, according to an embodiment of the disclosure.

The limit pin 92 stops further travel of valve operator 76 when it reaches the end of track 94. Continued application of hydraulic actuating fluid via hydraulic control line 36 causes continued shifting of mandrel 54 in the direction of arrows 96, as illustrated in FIG. 4. If sufficient pressure is applied, the second collet member 90 is forced to release from first collet member 88 and collet 86 separates.

Once collet 86 separates, the shifting of mandrel 54 may be continued until sliding sleeve 80 is moved away from circulating ports 82 and corresponding mandrel ports 84 are aligned with circulating ports 82. In this configuration, the circulating valve 32 is in an open flow configuration and the formation isolation valve 30 is in a closed flow configuration. However, the circulating valve 32 may subsequently be closed by reversing the shifting direction of mandrel 54 as illustrated by arrows 98 in FIG. 5.

Movement of operator mandrel 54 in the direction of arrows 98 may be achieved by supplying hydraulic actuating fluid through hydraulic control line 34 (and allowing fluid to bleed from hydraulic chamber 60 through hydraulic control line 36). The movement of mandrel 54 in the direction of arrows 98 causes corresponding mandrel ports 84 to move away from circulating ports 82 while sliding sleeve 80 and corresponding seals 70 once again close off flow through circulating ports 82.

Figure 5:
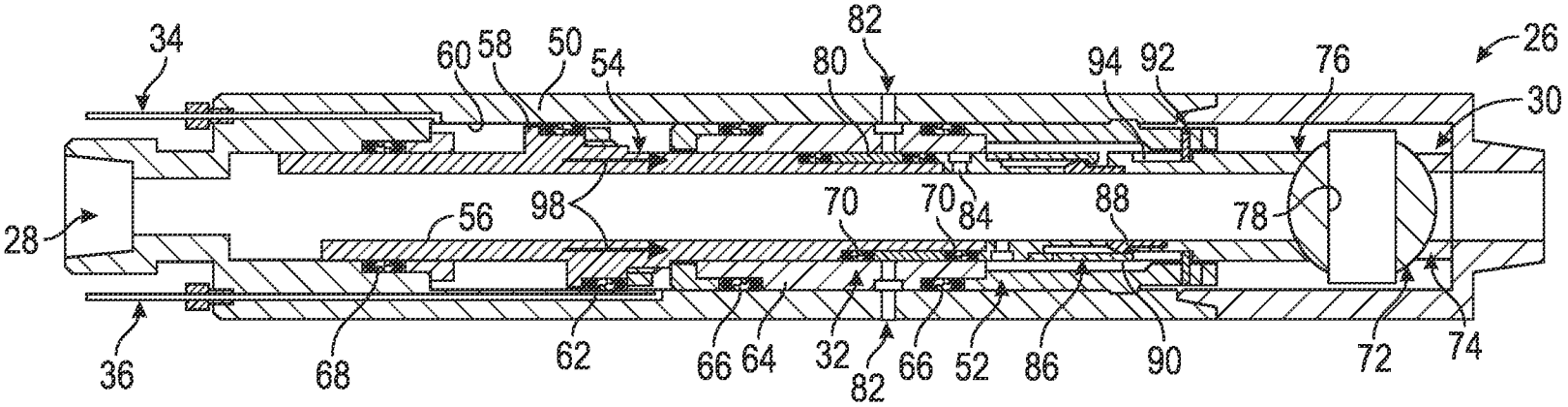
FIG. 5 is an illustration of the valve system of FIG. 2 in a different operational position, according to an embodiment of the disclosure.
Figure 6:
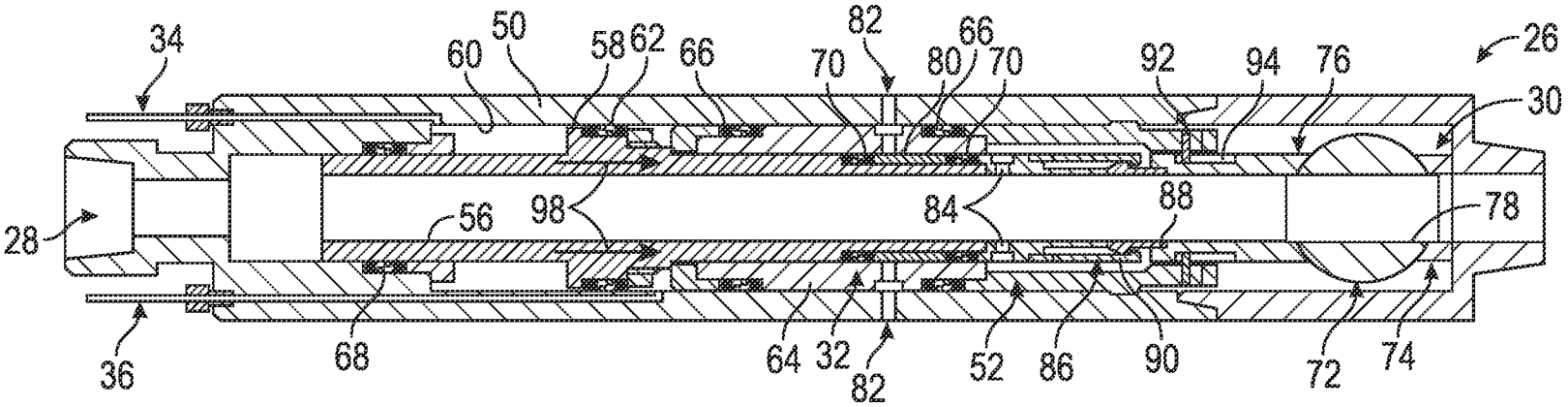
FIG. 6 is an illustration of the valve system of FIG. 2 in a different operational position, according to an embodiment of the disclosure.

During this shifting of operator mandrel 54 in the direction of arrows 98, the second collet member 90 may once again be moved into coupling engagement with first collet member 88, as illustrated in FIG. 5. Once the collet 86 is again engaged, continued movement of operator mandrel 54 in the direction of arrows 98 moves valve operator 76 and thus ball valve 72 to the open flow configuration illustrated in FIG. 6.

Figure 7:
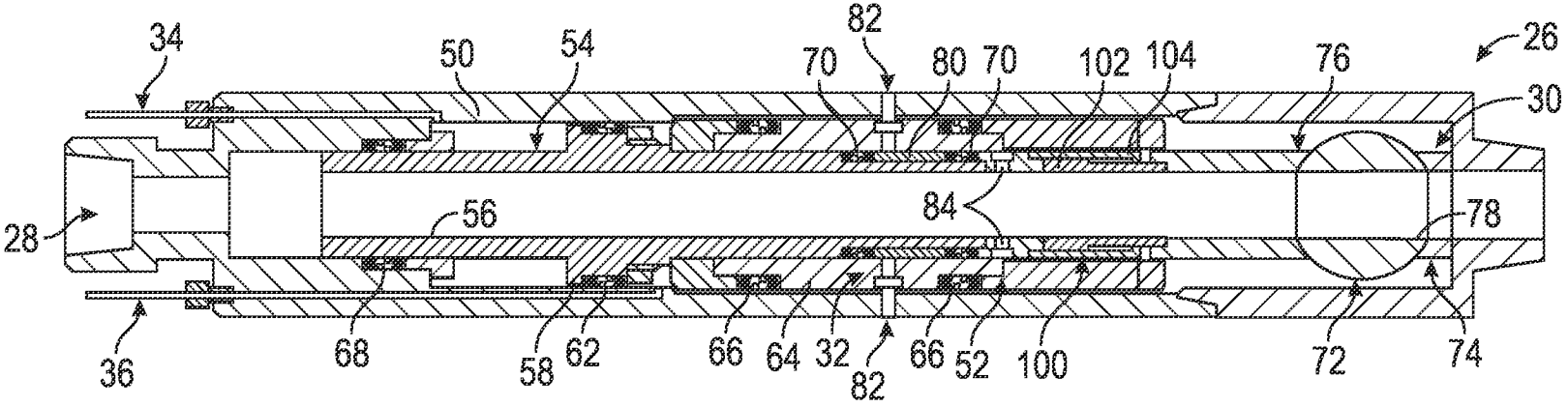
FIG. 7 is an illustration of another example of a valve system having a combined formation isolation valve and circulating valve operable via less than three hydraulic lines, according to an embodiment of the disclosure.

Referring generally to FIG. 7, another embodiment of valve system 26 is illustrated. In this example, many of the components are the same or similar to components in the embodiment illustrated in FIGS. 2-6 and have been labeled with the same reference numerals. However, the mechanical linkage 52 in this latter embodiment is in the form of a lost motion mechanism 100 instead of the collet 86. The lost motion mechanism 100 is constructed with a first member 102 coupled with valve operator 76 and a second member 104 coupled with mandrel 54. The first member 102 and second member 104 are slidably engaged with each other but limited to a predetermined longitudinal slide length.

In FIG. 7, the circulating valve 32 is illustrated in the closed flow position, and the formation isolation valve 30 is in the open flow position. This combination may be used as a running in hole (RIH) configuration. With additional reference to FIG. 8, changing of the valve configuration may be initiated by shifting the mandrel 54 in the direction of arrows 96. Again, the shifting of mandrel 54 in the direction of arrows 96 may be achieved by supplying hydraulic actuating fluid via hydraulic control line 36 (and allowing fluid to bleed from hydraulic chamber 60 through hydraulic control line 34).

Figure 8:
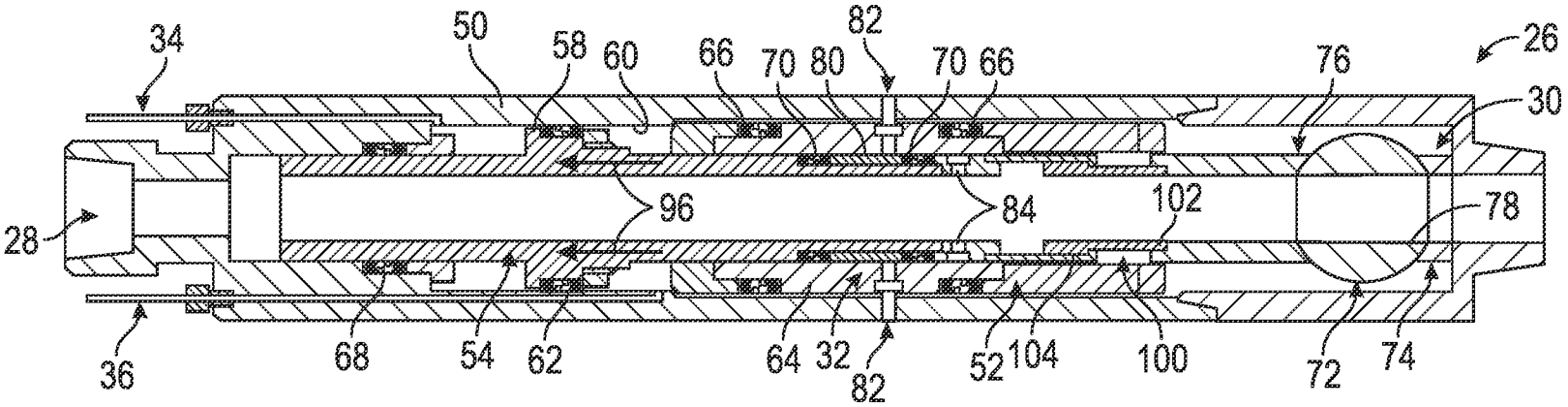
FIG. 8 is an illustration of the valve system of FIG. 7 in a different operational position, according to an embodiment of the disclosure.
Figure 9:
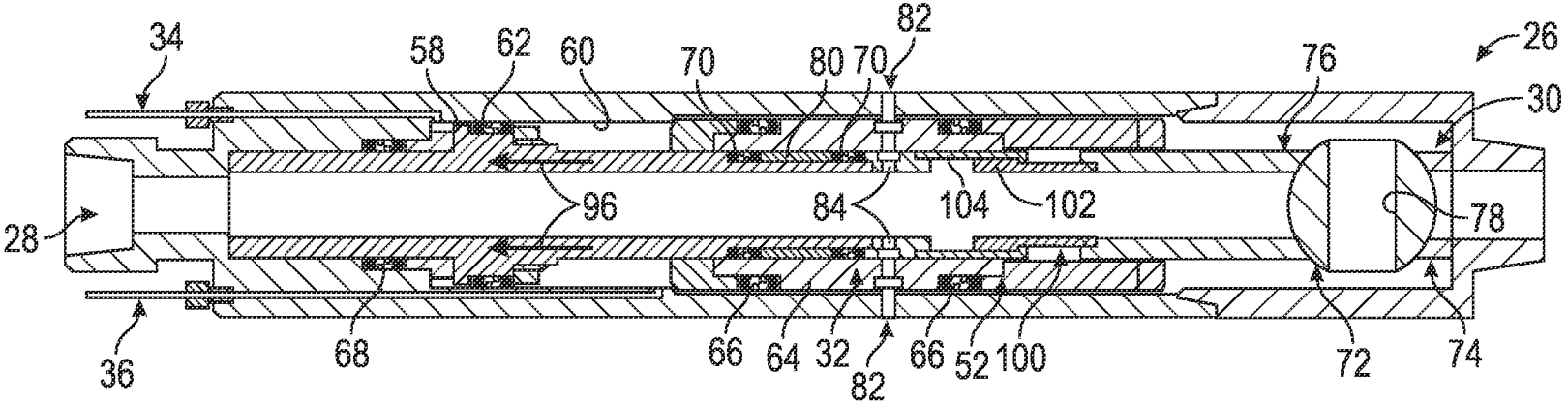
FIG. 9 is an illustration of the valve system of FIG. 7 in a different operational position, according to an embodiment of the disclosure.

This shifting of operator mandrel 54 causes the second member 104 to slide with respect to the first member 102 of lost motion mechanism 100 until further sliding motion is blocked via engagement of the ends of first member 102 and second member 104 as illustrated in FIG. 8. Continued shifting of mandrel 54 in the direction of arrows 96 causes the second member 104 to pull the first member 102 and thus the valve operator 76. This movement of valve operator 76 rotates ball valve 72 to the closed position illustrated in FIG. 9. Additionally, the sliding sleeve 80 is moved away from circulating ports 82 and corresponding mandrel ports 84 are aligned with circulating ports 82 as further illustrated in FIG. 9. In this configuration, the formation isolation valve 30 is closed, and the circulating valve 32 is in an open flow configuration.

Figure 10:
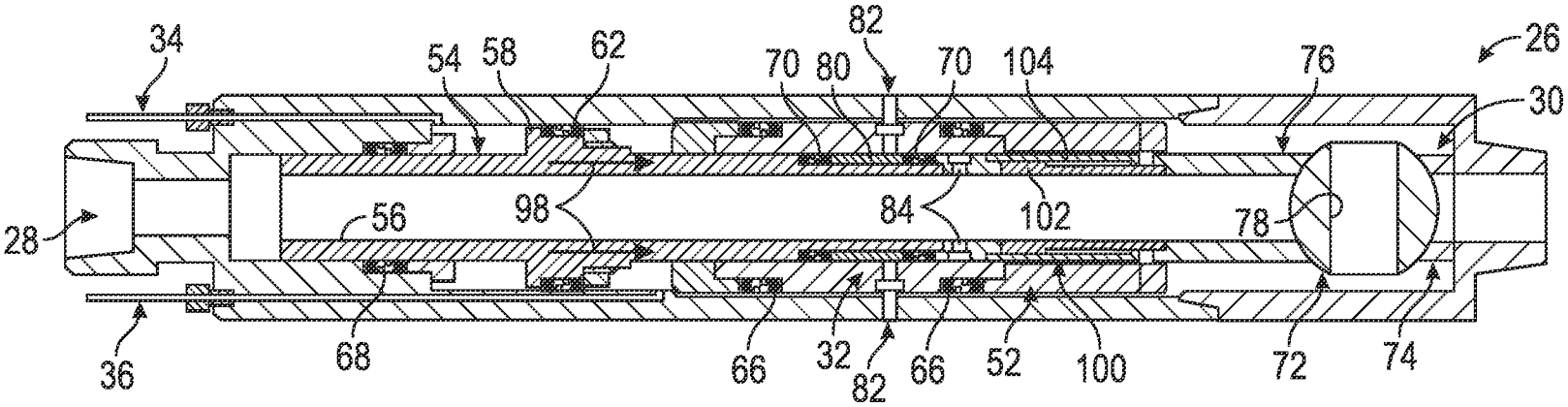
FIG. 10 is an illustration of the valve system of FIG. 7 in a different operational position, according to an embodiment of the disclosure.

The circulating valve 32 may subsequently be closed by reversing the shifting direction of mandrel 54 as illustrated by arrows 98 in FIG. 10. Movement of operator mandrel 54 in the direction of arrows 98 may be achieved by supplying hydraulic actuating fluid through hydraulic control line 34 (and allowing fluid to bleed from hydraulic chamber 60 through hydraulic control line 36). The movement of mandrel 54 causes corresponding mandrel ports 84 to move away from circulating ports 82 while sliding sleeve 80 and corresponding seals 70 once again close off flow through circulating ports 82.

Figure 11:
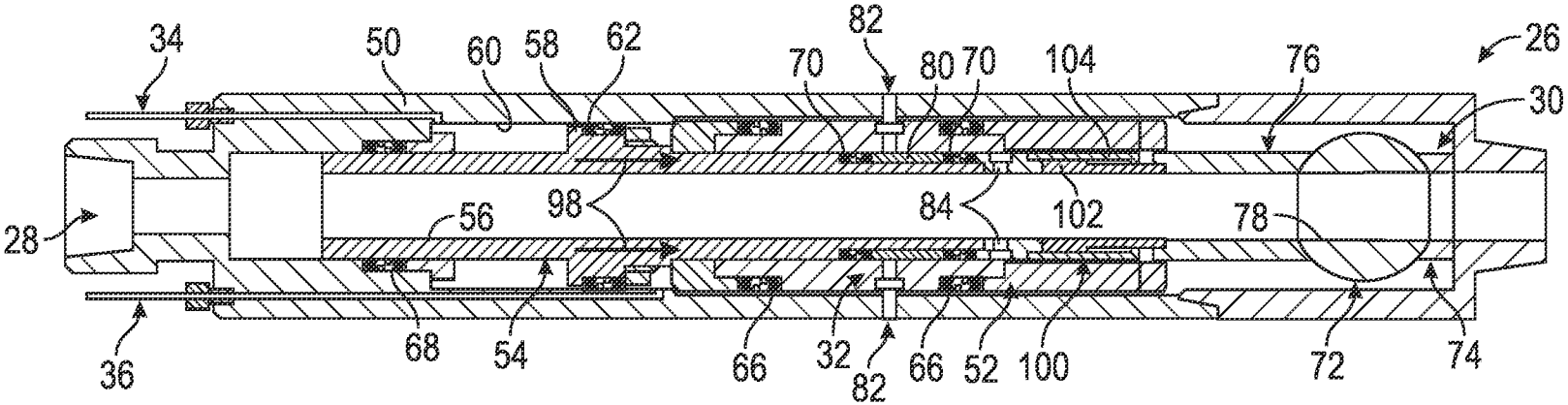
FIG. 11 is an illustration of the valve system of FIG. 7 in a different operational position, according to an embodiment of the disclosure.

During this shifting of operator mandrel 54 in the direction of arrows 98, the second member 104 is able to slide with respect to first member 102 of lost motion mechanism 100 in an opposite direction until bottoming out. Once the lost motion mechanism 100 has bottomed out, continued movement of operator mandrel 54 in the direction of arrows 98 moves valve operator 76 and thus ball valve 72 to the open flow configuration illustrated in FIG. 11. Thus, collet 86, lost motion mechanism 100, or other suitable mechanical linkages 52 may be used to enable independent actuation of the formation isolation valve 30 and the circulating valve 32 solely from hydraulic inputs supplied by two hydraulic control lines 34, 36.

Figure 12:
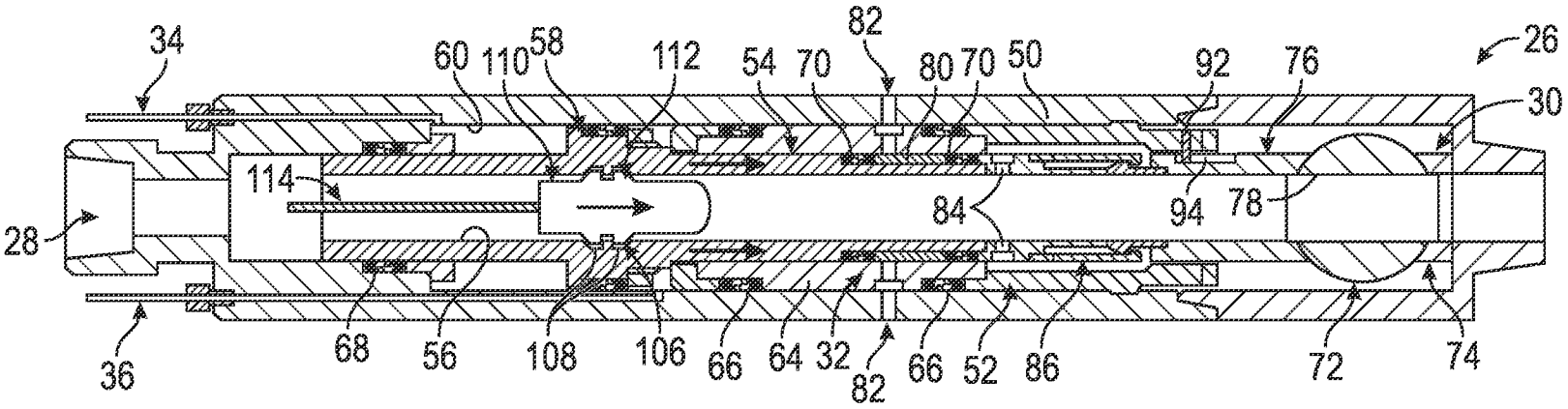
FIG. 12 is an illustration of another example of a valve system having a combined formation isolation valve and circulating valve operable via less than three hydraulic lines, according to an embodiment of the disclosure.

Referring generally to FIG. 12, another embodiment of valve system 26 is illustrated. In this example, the operator mandrel 54 comprises a profile 106. By way of example, the profile 106 may be in the form of recesses 108, e.g. grooves, formed along an interior surface of the mandrel 54. The profile 106 is configured for engagement with a shifting tool 110 having a corresponding profile 112. The shifting tool 110 effectively provides a contingency technique for opening and/or closing the valves 30, 32 mechanically.

By way of example, the shifting tool 110 may be deployed along internal flow passage 28 via a conveyance 114, e.g. a slick line, braided cable, coiled tubing, or other suitable conveyance. Once the shifting tool 110 is engaged with profile 106 of operator mandrel 54, the conveyance 114 may be used to mechanically move the shifting tool 110 and thus the mandrel 54 for mechanical shifting of at least one of the valves 30, 32. Such mechanical shifting may be used as a contingency to the hydraulic shifting described above. It should be noted the profile 106 and shifting tool 110 may be used with each of the embodiments described herein.

According to another embodiment illustrated in FIGS. 13-22, the well system 20 may comprise an upper completion 120 and an integrated shifting tool 122 attached to a lower end of the upper completion 120. In various embodiments, the upper completion 120 also may be part of tubing section 24 and may be combined with or comprise electric submersible pumping system 40. As with other embodiments described herein, the tubing section 24 also may comprise the combined valves 30, 32. In the embodiment illustrated in FIGS. 13-22, the integrated shifting tool 122 may be operably engaged with the combined formation isolation valve 30 and circulating valve 32. The integrated shifting tool 122 may be operable to selectively open and close the formation isolation valve 30 and the circulating valve 32. By way of example, the integrated shifting tool 122 may comprise a hydraulic shifting tool or an electric shifting tool.

With a hydraulic integrated shifting tool 122, "open" and "close" hydraulic lines 34, 36 may be run from the surface and used to retract and extend the shifting tool 122 to close and open the combined valves 30, 32 sequentially. Depending on the parameters of a given operation, the formation isolation valve 30 may be closed first before opening of the circulating valve 32 and the circulating valve 32 may then be closed before opening the reservoir/formation isolation valve 30. The formation isolation valve 30 may again be in the form of a ball valve or other suitable valve. Additionally, the integrated shifting tool 122 may be retrieved with the upper completion 120 and rerun back into the well with the upper completion 120.

Figure 13:
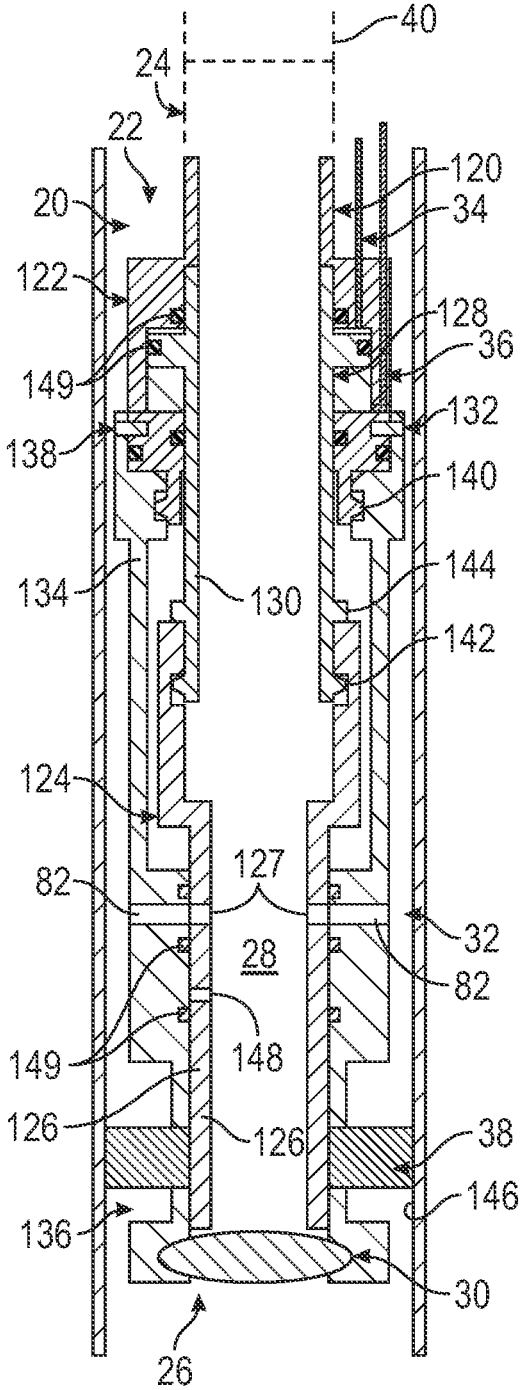
FIG. 13 is an illustration of another example of a valve system having a shifting tool attached to an upper completion and operably engaged with a formation isolation valve and circulating valve, according to an embodiment of the disclosure.

Referring generally to FIG. 13, an example of well system 20 is illustrated as having a hydraulic type integrated shifting tool 122. The shifting tool 122 is illustrated as configured for operating a combined formation isolation valve 30 and circulating valve 32. The formation isolation valve 30 and the circulating valve 32 are selectively opened via an actuator member 124 moved via shifting tool 122. In some embodiments, the actuator member 124 may be in the form of a sleeve member 126. For example, the circulating valve 32 may be in the form of a sleeve valve having lateral ports 82, e.g. circulating ports, which are opened and closed via alignment and misalignment, respectively, of corresponding sleeve member lateral ports 127 formed through the side wall of sleeve member 126.

The open hydraulic line 34 and the close hydraulic line 36 may be used to carry hydraulic fluid under pressure for selectively opening and closing the formation isolation valve/ball valve 30 and the circulating valve 32. For example, open hydraulic line 34 and close hydraulic line 36 may be coupled with integrated shifting tool 122 to work in cooperation with a hydraulic piston 128. Hydraulic piston 128 may be coupled with a tubular portion 130, which extends through an anchor latch 132. When actuating fluid is supplied under pressure through one of the hydraulic lines 34, 36 to actuate piston 128 in a given direction, the other hydraulic line may serve as a bleed line.

The anchor latch 132 may be coupled with a surrounding housing 134 of, for example, a lower completion 136. By way of example, the anchor latch 132 may be coupled with housing 134 via a shear member 138, e.g. shear pins as illustrated, or via a hydraulic release or other suitable connection mechanism. The anchor latch 132 also may be coupled with a snap latch collet 140 releasably engaged with the surrounding housing 134.

The tubular portion 130 (coupled with or part of the hydraulic piston 128) may be releasably engaged with actuator member 124. As illustrated, the actuator member 124 may comprise sleeve member 126. In such an embodiment, the sleeve member 126 serves as a tubular valve operator for selectively operating formation isolation valve 30 and circulating valve 32. In some embodiments, the tubular portion 130 may be connected with the actuator member 124 via another snap latch collet 142 or other suitable coupling mechanism to facilitate operation of valves 30 and 32. Additionally, a no go 144, e.g. an abutment, may be positioned along tubular portion 130 to ensure formation isolation valve 30, e.g. ball valve, may be selectively shifted to an open position.

This embodiment of well system 20 also may comprise packer 38 positioned externally of the surrounding housing 134. As with the previously described embodiments, the packer 38 may be oriented for engagement with a borehole wall 146, e.g. a casing. A packer inflation passage 148 may be located through a wall of sleeve member 126 to facilitate setting of the packer 38. A variety of seals 149 may be positioned between components as illustrated to form desired sealed areas. The sealed areas facilitate operation of system components, such as piston 128, anchor latch 132, and circulating valve 32. It should be noted that in some embodiments, the anchor latch 132 may be optional.

Figure 14:
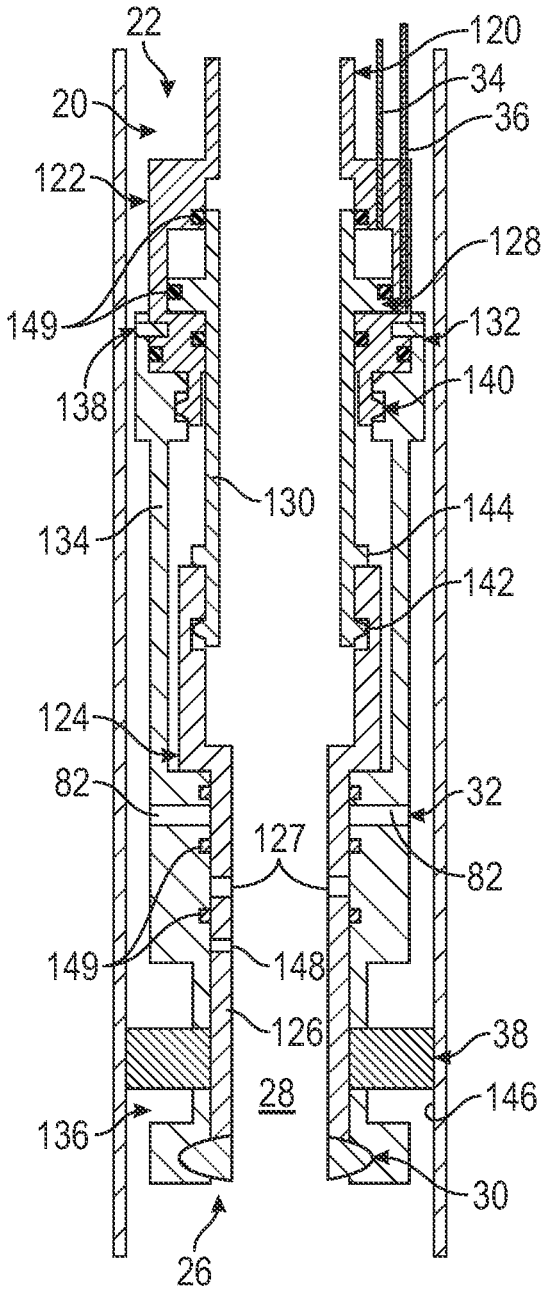
FIG. 14 is an illustration of the valve system of FIG. 13 but in a different operational position, according to an embodiment of the disclosure.

In an operational example: when the well system 20 is run in hole, the hydraulic piston 128 is actuated via the open hydraulic line 34 to move the tubular valve actuator/sleeve member 126 so as to shift the ball valve 30 to an open position, as illustrated in FIG. 14. In this position, the circulating valve 32 is in a closed position because lateral ports 127 in the tubular valve actuator/sleeve member 126 have been moved out of alignment with lateral passages 82 (extending through the surrounding housing 134) as illustrated.

Figure 15:
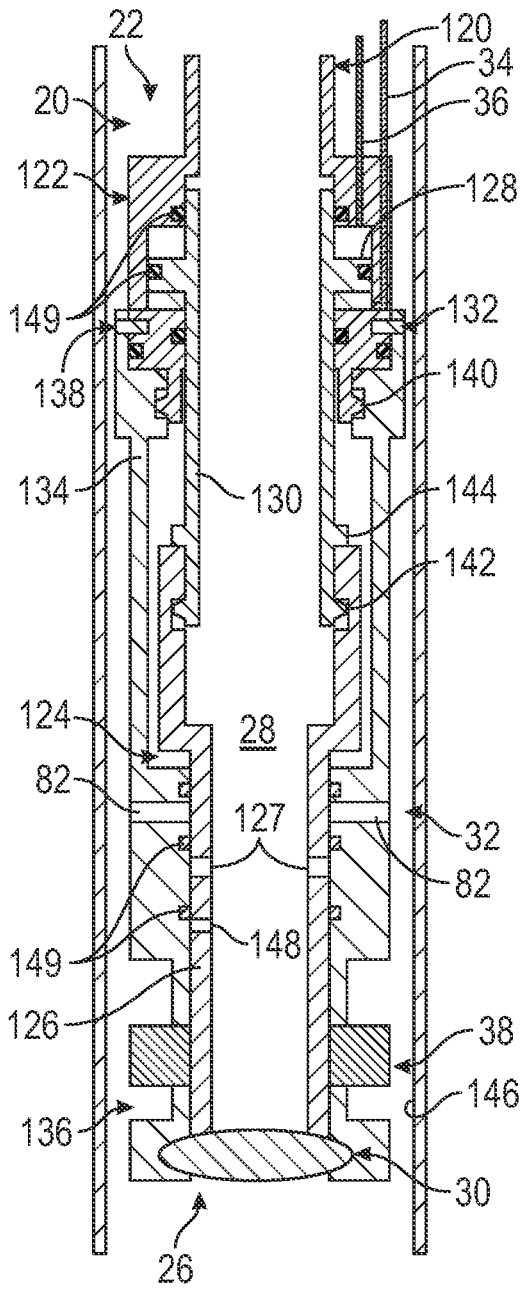
FIG. 15 is an illustration of the valve system of FIG. 13 but in a different operational position, according to an embodiment of the disclosure.
Figure 16:
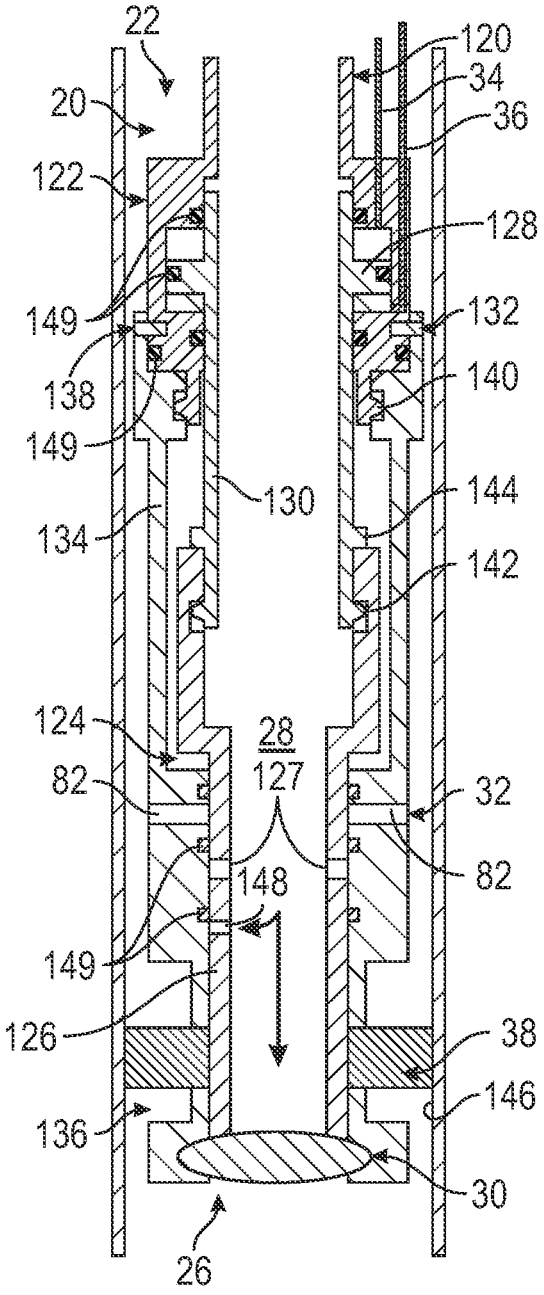
FIG. 16 is an illustration of the valve system of FIG. 13 but in a different operational position, according to an embodiment of the disclosure.

Referring generally to FIG. 15, the ball valve 30 may subsequently be closed while maintaining the circulating valve in a closed position by applying an appropriate pressure, e.g. 1000 psi or other suitable pressure, in the close hydraulic line 36. The pressure applied to close hydraulic line 36 is able to partially shift the hydraulic piston 128, as illustrated in FIG. 15. This allows pressure to be applied within the tubing and against the closed valves to enable setting of the packer 38 via passage 148, as illustrated in FIG. 16.

Figure 17:
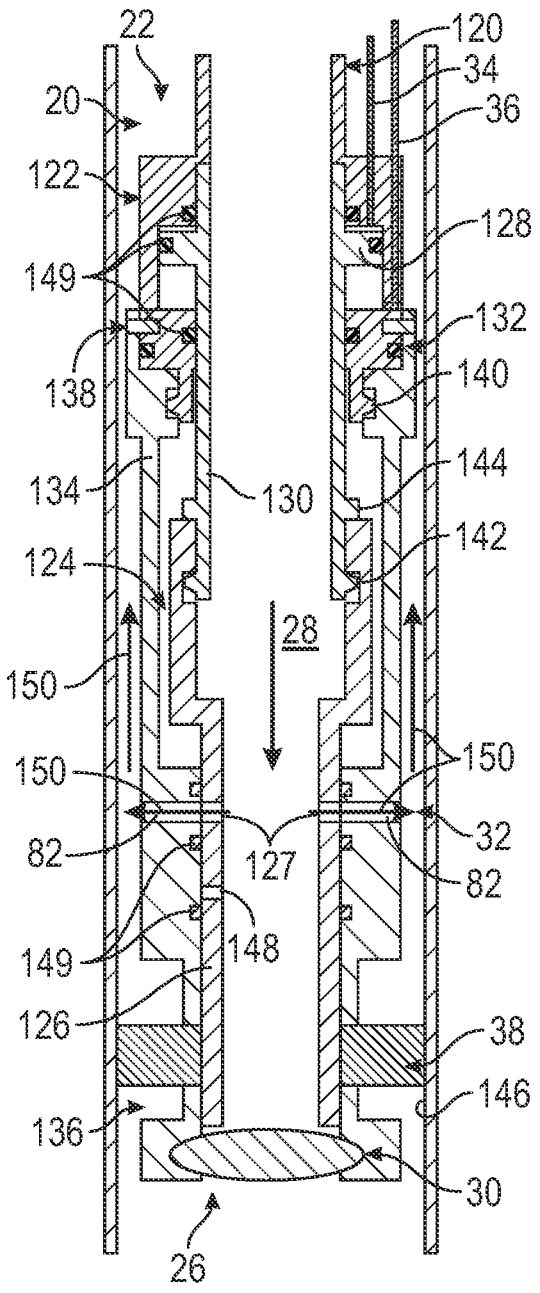
FIG. 17 is an illustration of the valve system of FIG. 13 but in a different operational position, according to an embodiment of the disclosure.
Figure 18:
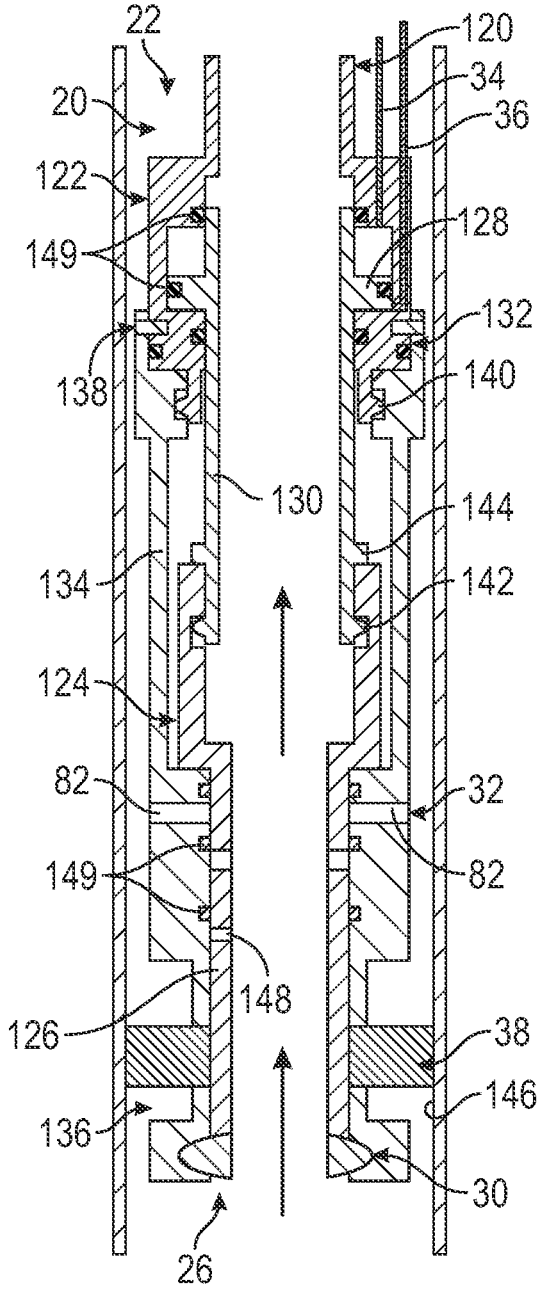
FIG. 18 is an illustration of the valve system of FIG. 13 but in a different operational position, according to an embodiment of the disclosure.

According to this operational example, the pressure in the close hydraulic line 36 may further be increased, e.g. increased to 2000 psi or other suitable pressure, to further shift the hydraulic piston 128 so as to open the circulating valve 32, as illustrated in FIG. 17. At this stage, fluids may be circulated down through the interior 28 and out into the surrounding annulus through lateral ports 127 and lateral passages 82 as represented by arrows 150. In this position, the circulating valve 32 is in an open flow position and the formation isolation/ball valve 30 is in a closed position. Suitable hydraulic pressure may then be applied in the open hydraulic line 34 to subsequently close the circulating valve 32 and to again open the ball valve 30 as illustrated in FIG. 18. As illustrated, the piston 128 has once again been shifted to transition the valves 30, 32.

Figure 19:
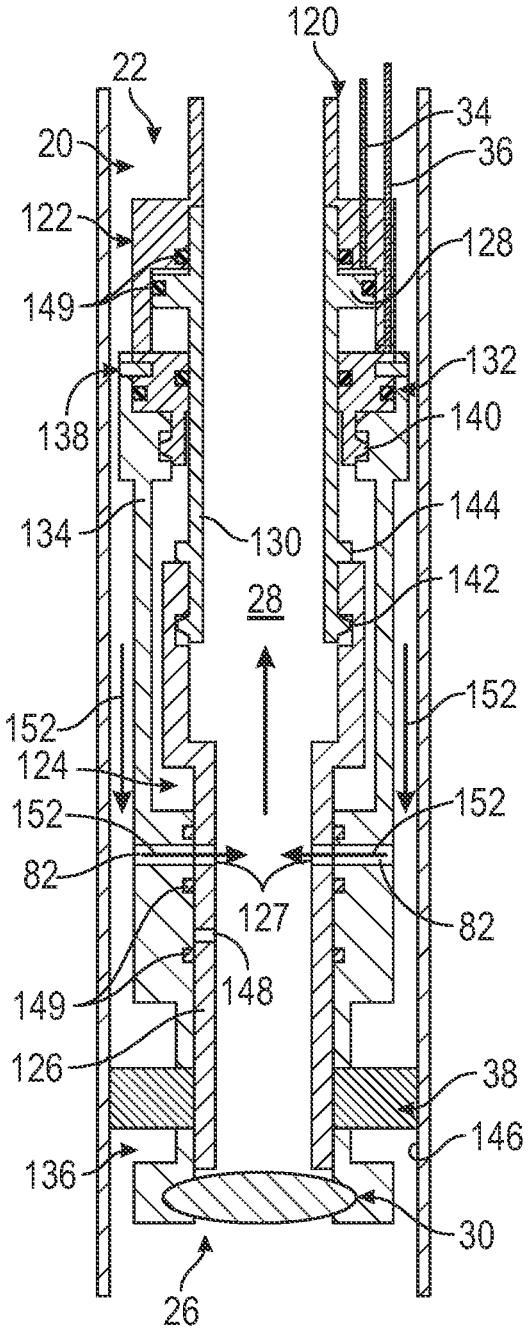
FIG. 19 is an illustration of the valve system of FIG. 13 but in a different operational position, according to an embodiment of the disclosure.
Figure 20:
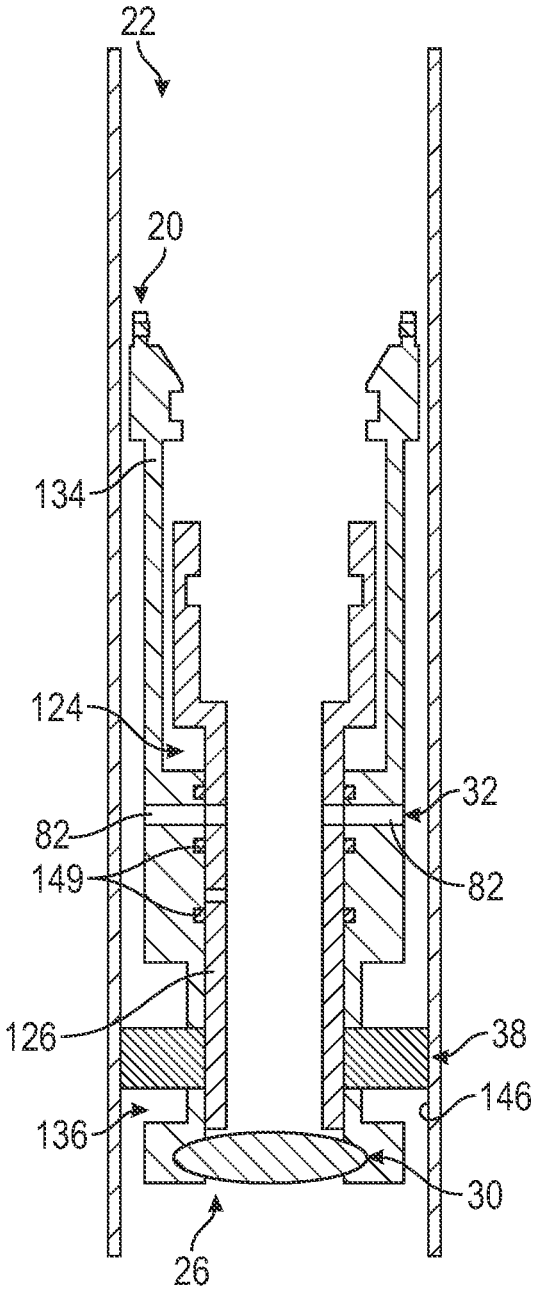
FIG. 20 is an illustration of the valve system of FIG. 13 but in a different operational position, according to an embodiment of the disclosure.

During an ESP workover operation, however, pressure may be increased in the close hydraulic line 36 to a suitable level, e.g. 2000 psi or other suitable pressure, to close the ball valve 30 and open the circulating valve 32, as illustrated in FIG. 19. In this position, hydrocarbons may be reversed out along interior 28 and displaced with kill weight fluid, as represented by arrows 152, to provide a fluid barrier for well control. The upper completion 120 may then be picked up so the anchor latch 132 is released via shearing of shear member 138 and release of snap latch collet 140. Once the anchor latch 132 is released, the upper completion 120 may be pulled out of hole for the workover, as illustrated in FIG. 20.

In some embodiments, the anchor latch 132 may be constructed to hydraulically actuate in response to applied pressure. In such an embodiment, the anchor latch 132 may be released by applying sufficient pressure in the annulus to cause actuation and release of the anchor latch 132 so the upper completion 120 may be pulled out of hole. In some embodiments, this type of hydraulically actuated release may be the primary option used to release snap latch collet 140. The shear member 138 may then serve as a contingency release which responds to a straight pull applied to the upper completion 120. As a further contingency, the snap latch collet 142 may be used to close the formation isolation/ball valve 30 when the upper completion 120 is pulled out of hole in case the valve 30 does not sufficiently close via operation of the integrated shifting tool 122.

Figure 21:
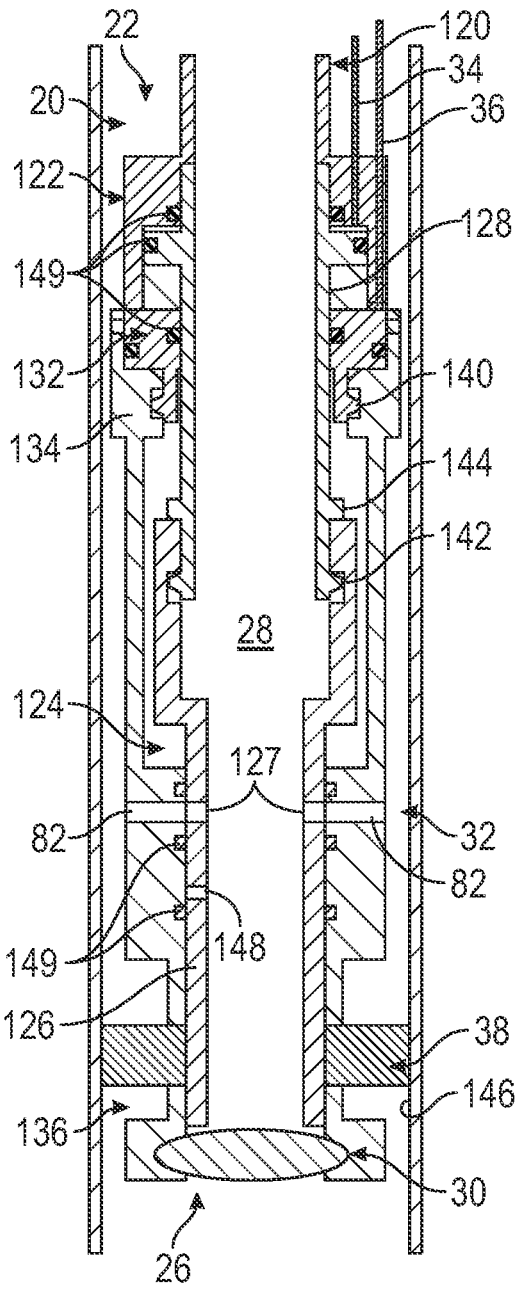
FIG. 21 is an illustration of the valve system of FIG. 13 but in a different operational position, according to an embodiment of the disclosure.
Figure 22:
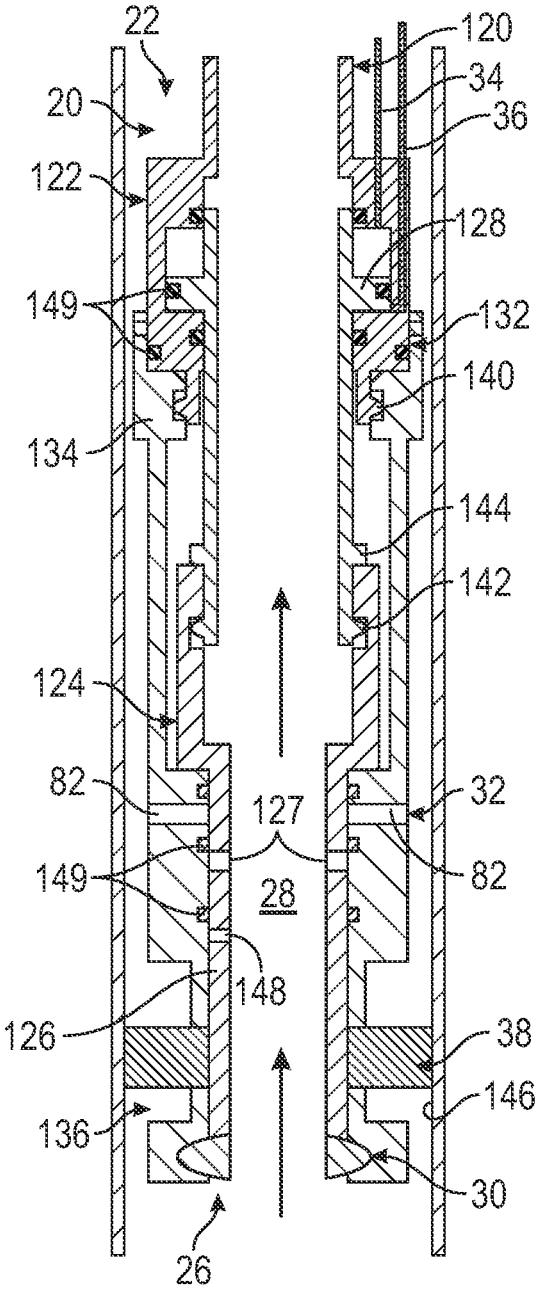
FIG. 22 is an illustration of the valve system of FIG. 13 but in a different operational position, according to an embodiment of the disclosure.

Subsequently, the upper completion 120 and the integrated shifting tool 122 may be run in hole. The shifting tool 122 may be moved downhole until engaged with the surrounding housing 134 and with the sleeve member 126, as illustrated in FIG. 21. As described above, sufficient pressure may then be applied in the open hydraulic line 34 to close the circulating valve 32 and to open the ball valve 30, as illustrated in FIG. 22. Depending on the actions desired for a given well operation, the valves 30, 32 may be selectively opened and closed via operation of the integrated shifting tool 122 as described above.

Figure 23:
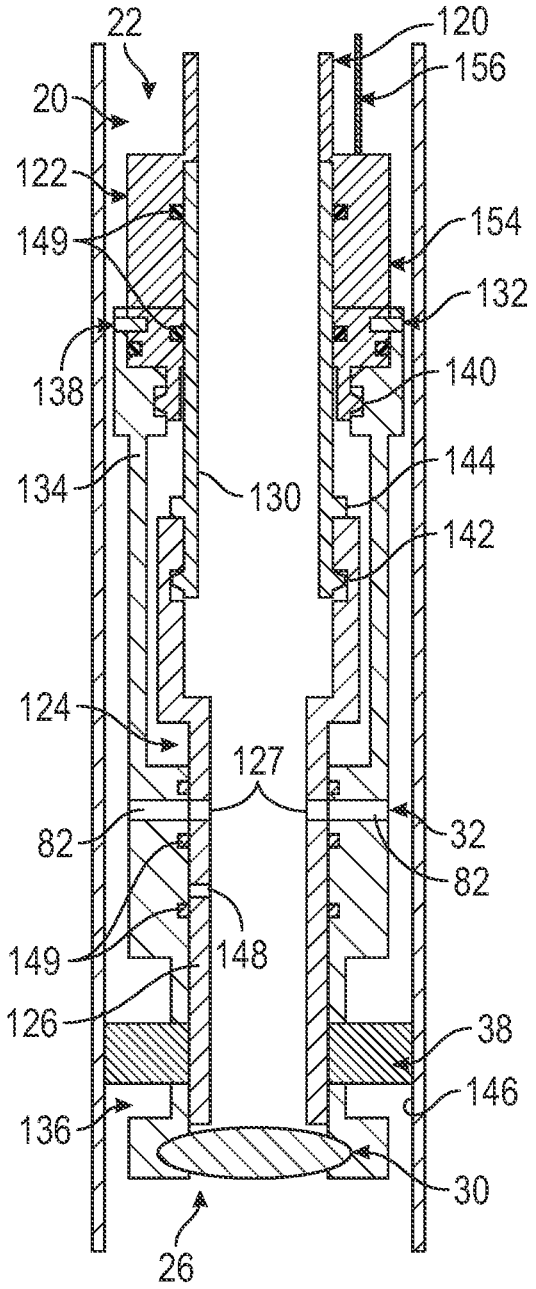
FIG. 23 is an illustration of another example of a valve system having a shifting tool attached to an upper completion and operably engaged with a formation isolation valve and circulating valve, according to an embodiment of the disclosure.
Figure 24:
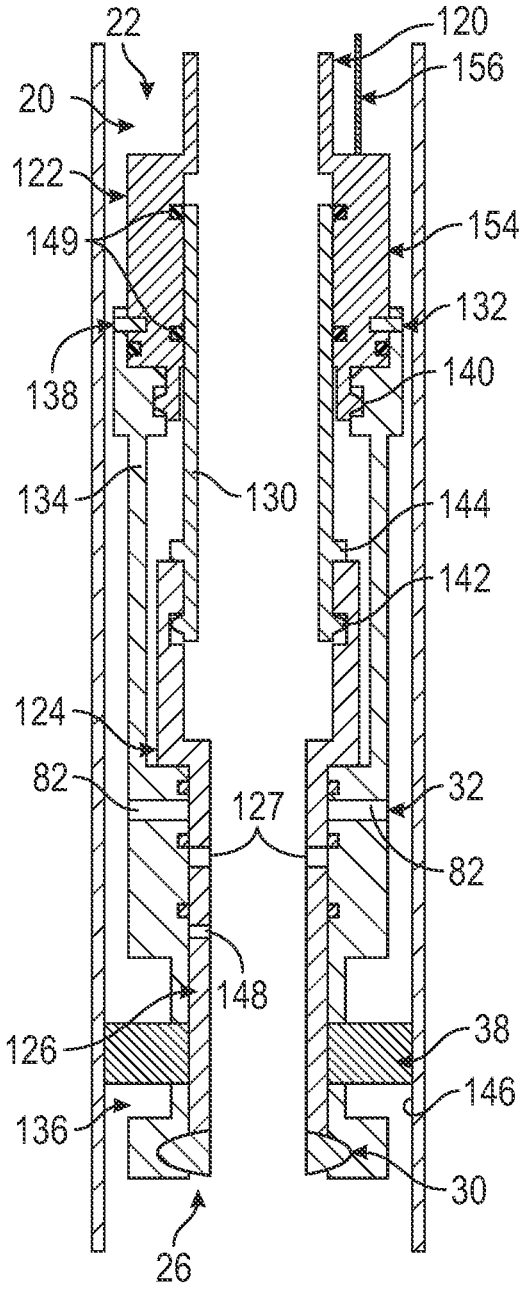
FIG. 24 is an illustration of the valve system of FIG. 23 but in a different operational position, according to an embodiment of the disclosure.

Referring generally to FIGS. 23-24, another embodiment of the integrated shifting tool 122 is illustrated. In this example, the shifting tool 122 is an electric shifting tool rather than a hydraulically actuated shifting tool. Many components of this embodiment are the same or similar to components of the embodiment illustrated and described with reference to FIGS. 13-22 and have been labeled with common reference numerals. However, the valve actuator 124 is shifted via an electric motor and electronics module 154 which receives power via an electric power cable 156. In some embodiments, the electric power cable 156 may receive power from an electric submersible pumping system cable.

In FIG. 23, the formation isolation/ball valve 30 is illustrated as closed while the circulating valve 32 is open. By providing a suitable electric signal via the electric power cable 156, the electric motor and electronics module 154 is operated to shift the valve actuator 124 so as to open the ball valve 30 and to close the circulating valve 32, as illustrated in FIG. 24. The electric motor and electronics module 154 may be constructed in a variety of configurations. By way of example, the module 154 may comprise an electronic section which receives and processes signals to control a corresponding motor which is able to move tubular portion 130, thus shifting valve actuator 124. The motor may be in the form of a linear motor, stepper motor, lead screw motor, or other suitable motor which may be operatively coupled with tubular portion 130 or with another suitable component able to selectively shift valve actuator 124.

It should be noted the sleeve member 126 may be constructed with a profile, e.g. an internal profile 106 as discussed above with reference to FIG. 12. As with other embodiments, the profile 106 may be in the form of recesses 108, e.g. grooves, formed along, for example, an interior surface of sleeve 126. The profile 106 may be configured for engagement with shifting tool 110 having corresponding profile 112 as discussed with reference to FIG. 12. The shifting tool 110 similarly provides a contingency technique for opening and/or closing the valves 30, 32 mechanically.

In various applications, the valve system 26 and/or integrated shifting tool 122 may be used with many types of well systems and non-well related systems to simplify the hydraulic control of two valves. In a variety of well operations, two hydraulic control lines may be used to independently control a formation isolation valve and a circulating valve. However, the system and methodology may be used to independently control other types of valves in other types of well operations. Additionally, the size and configuration of various components such as the mandrel, seals, hydraulic actuation fluid porting, mechanical linkage, valves, valve operator, seals, circulating valve ports, mechanical linkages, collets, and shear/hydraulic releases may be adjusted according to the parameters of a given operation and environment.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a tubing section deployed downhole in a wellbore, the tubing section having an internal flow passage exposed to well fluids;

a valve system coupled with the tubing section and comprising a formation isolation valve and a circulating valve operatively coupled together by a mechanical linkage comprising at least one of a collet or a lost motion mechanism, the formation isolation valve controlling flow along the internal flow passage and the circulating valve controlling flow between the internal flow passage and an exterior of the valve system; and a pair of hydraulic control lines in fluid communication with the valve system, wherein the valve system is selectively shiftable via the pair of hydraulic control lines between a first position having the isolation valve open and the circulating valve closed, a second position having the isolation valve closed and the circulating valve closed, and a third position having the isolation valve closed and the circulating valve open.

2. The system as recited in claim 1, wherein the formation isolation valve comprises a ball valve.

3. The system as recited in claim 1, wherein the circulating valve comprises a sliding sleeve valve.

4. The system as recited in claim 3, wherein the formation isolation valve comprises a ball valve.

5. The system as recited in claim 1, wherein the tubing system extends from an electric submersible pumping system docking station.

6. The system as recited in claim 5, further comprising an electric submersible pumping system docked in the electric submersible pumping system docking station in fluid communication with the tubing section.

7. The system as recited in claim 1, wherein the valve system comprises a shiftable mandrel which may be shifted back and forth via hydraulic inputs applied through the pair of hydraulic control lines.

8. A method, comprising:

providing a valve system with a formation isolation valve and a circulating valve;

coupling the formation isolation valve with the circulating valve via a mechanical linkage comprising at least one of a collet or a lost motion mechanism;

deploying the valve system downhole into a wellbore on a tubing section; and selectively operating the valve system via a pair of hydraulic control lines to one of a first position having the isolation valve open and the circulating valve closed, a second position having the isolation valve closed and the circulating valve closed, and a third position having the isolation valve closed and the circulating valve open.

9. The method as recited in claim 8, wherein operating comprises operating the formation isolation valve and the circulating valve with an integrated shifting tool mounted to an upper completion.

* * * * *